United States Patent [19]

Pritchard

[11] Patent Number: 5,000,355

[45] Date of Patent: Mar. 19, 1991

[54] PUMP DISPENSER

[75] Inventor: Robert W. Pritchard, Pittsburgh, Pa.

[73] Assignee: Beecham Inc., Clifton, N.J.

[21] Appl. No.: 892,141

[22] Filed: Jul. 30, 1986

[51] Int. Cl.[5] ..... B67D 5/42

[52] U.S. Cl. ..... 222/256; 222/386

[58] Field of Search ..... 222/386, 387, 391, 256

[56] References Cited

U.S. PATENT DOCUMENTS

| | | | |
|---|---|---|---|
| Re. 31,408 | 10/1983 | Czech et al. . | |
| 1,668,511 | 5/1928 | McLaughlin | 222/387 |
| 1,757,736 | 5/1930 | Pritchard . | |
| 3,088,636 | 5/1963 | Spatz . | |
| 3,255,935 | 6/1966 | Spatz . | |
| 3,268,123 | 8/1966 | Spatz . | |
| 3,361,305 | 1/1968 | Spatz . | |
| 3,674,181 | 7/1972 | Marks et al. | 222/386 |
| 3,768,705 | 10/1973 | Spatz . | |
| 3,870,200 | 3/1975 | Spatz . | |
| 4,301,948 | 11/1981 | Czech et al. . | |
| 4,394,939 | 7/1983 | Thor et al. . | |
| 4,402,431 | 9/1983 | Wiegner et al. . | |
| 4,413,759 | 11/1983 | Mettenbrink . | |

FOREIGN PATENT DOCUMENTS

| | | |
|---|---|---|
| 962757 | 7/1964 | United Kingdom . |
| 2152152 | 7/1985 | United Kingdom . |
| 2157372 | 10/1985 | United Kingdom . |
| 2161863 | 1/1986 | United Kingdom . |

*Primary Examiner*—H. Grant Skaggs

*Attorney, Agent, or Firm*—Jacobs & Jacobs

[57] ABSTRACT

A dispenser of the type having an elongated reservoir for storing toothpaste or other fluent material, an outlet nozzle at one end of the reservoir, and a one-way piston at the other end of the reservoir in contact with the fluent material, the one-way piston comprising a body portion having a top surface for contacting material in the reservoir, a flexible annular sealing member for sealingly engaging the inner wall of the reservoir, and one or more air-venting passages for permitting air trapped between the fluent material in the reservoir and the piston to be vented to the atmosphere as the piston is inserted into the dispenser and into contact with the material.

16 Claims, 2 Drawing Sheets

FIG. 1
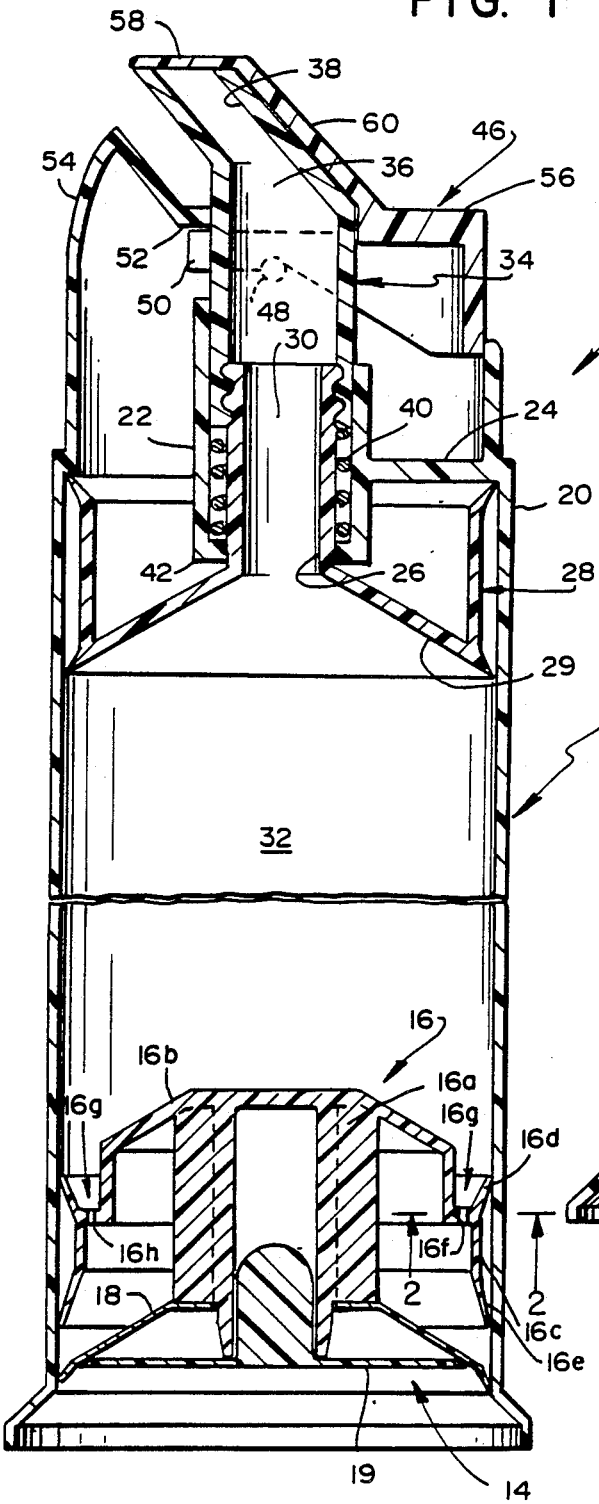
FIG. 2
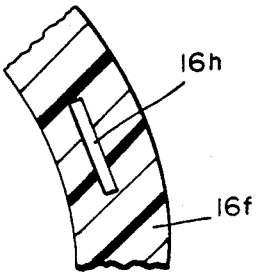
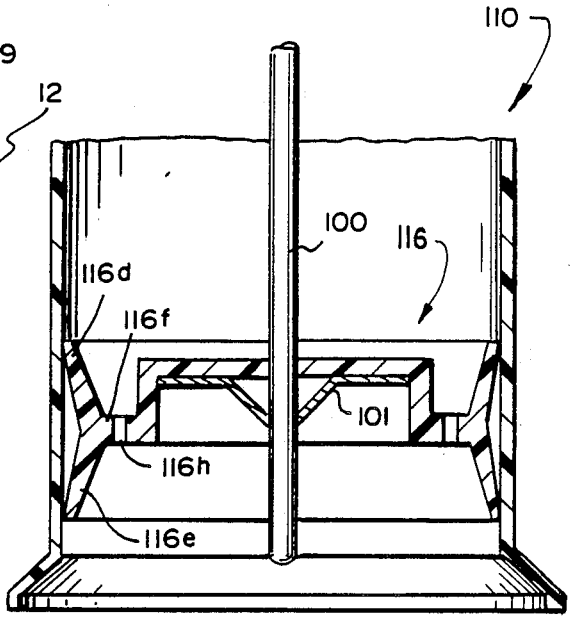
FIG. 3

PUMP DISPENSER

The present invention is directed to dispensers for fluent masses, and more particularly to pump dispensers that have a discharge outlet at one end and a piston or follower at the other end of the dispenser.

Pump dispensers for fluent masses are known in which a discharge nozzle or outlet is at one end and a one-way piston or follower is at the other end. The piston is in contact with the fluent mass in the dispenser, and the piston progressively moves toward the discharge nozzle as the fluent mass is dispensed. U.S. Pat. No. 3,870,200 to Walter B. Spatz discloses a pump dispenser that creates a partial vacuum therein after each dispensing operation, which in turn causes atmospheric pressure to move the piston toward the discharge outlet. U.S. Pat. No. 3,255,935 to Walter B. Spatz discloses a pump dispenser that uses a piston rod linked between the piston and a pump actuator to move the piston toward the discharge outlet. Many variations exist upon these basic themes, but in each case a one-way clutch or latch device is employed to prevent the piston from moving away from the discharge outlet. In such cases, the piston is referred to as a one-way piston.

Pump dispensers are also known comprising a pumping chamber, a reservoir for the fluent mass and a piston or follower in contact with the fluent mass in the reservoir. In such two-chamber dispensers, a partial vacuum is created in the pumping chamber after each dispensing operation, which is used to replenish the pumping chamber with fluent mass in the reservoir. The piston or follower progressively moves toward the discharge nozzle of the dispenser as the fluent mass is dispensed, but the piston is not a one-way piston. U.S. Pat. No. 3,361,305 to Walter B. Spatz, U.S. Pat. No. 4,394,939 to Gunter Thor et al. and U.S. Pat. No. 4,402,431 to Georg Wiegner et al. are illustrative of two-chamber pump dispensers.

Toothpaste pump dispensers are commonly filled in an inverted position through the open bottom thereof, after which the piston is inserted through the open bottom into contact with the toothpaste. This results in entrapping some air between the piston and the toothpaste, which gives rise to many problems.

For example, since toothpaste pump dispensers are normally stored and shipped in the upright position with the discharge outlet at the top of the dispenser, entrapped air will rise to the top where it can displace toothpaste from the discharge outlet. This causes a loss of "priming" of the pump and the consumer must manually prime the pump before use. In some cases, the air bubble at the top is large enough to render the pump inoperative.

The present invention now provides an improved dispenser of the type having an elongated reservoir for storing toothpaste or other fluent material, an outlet at one end of the reservoir, and a piston or follower at the other end of the reservoir in contact with said fluent material, said piston comprising a body portion comprising a body portion having a surface for contacting material in said reservoir, a flexible annular sealing means for sealingly engaging the inner wall of the reservoir, and air-venting passage means for permitting air trapped between fluent material in the reservoir and said piston to pass therethrough to the atmosphere as said piston is inserted into a said dispenser and into contact with said material.

In a preferred embodiment of the invention, the dispenser is a toothpaste pump dispenser, which includes pumping means for pumping toothpaste from said reservoir and out of said outlet nozzle.

The present invention is illustrated in terms of its preferred embodiments in the accompanying drawing, in which:

FIG. 1 is an elevational view, in section, of a dispenser incorporating the piston according to the present invention;

FIG. 2 is a view, in section, taken along lines 2—2 in FIG. 1;

FIG. 3 is a view, similar to FIG. 1, of an alternative embodiment of the invention.

Figure 4:
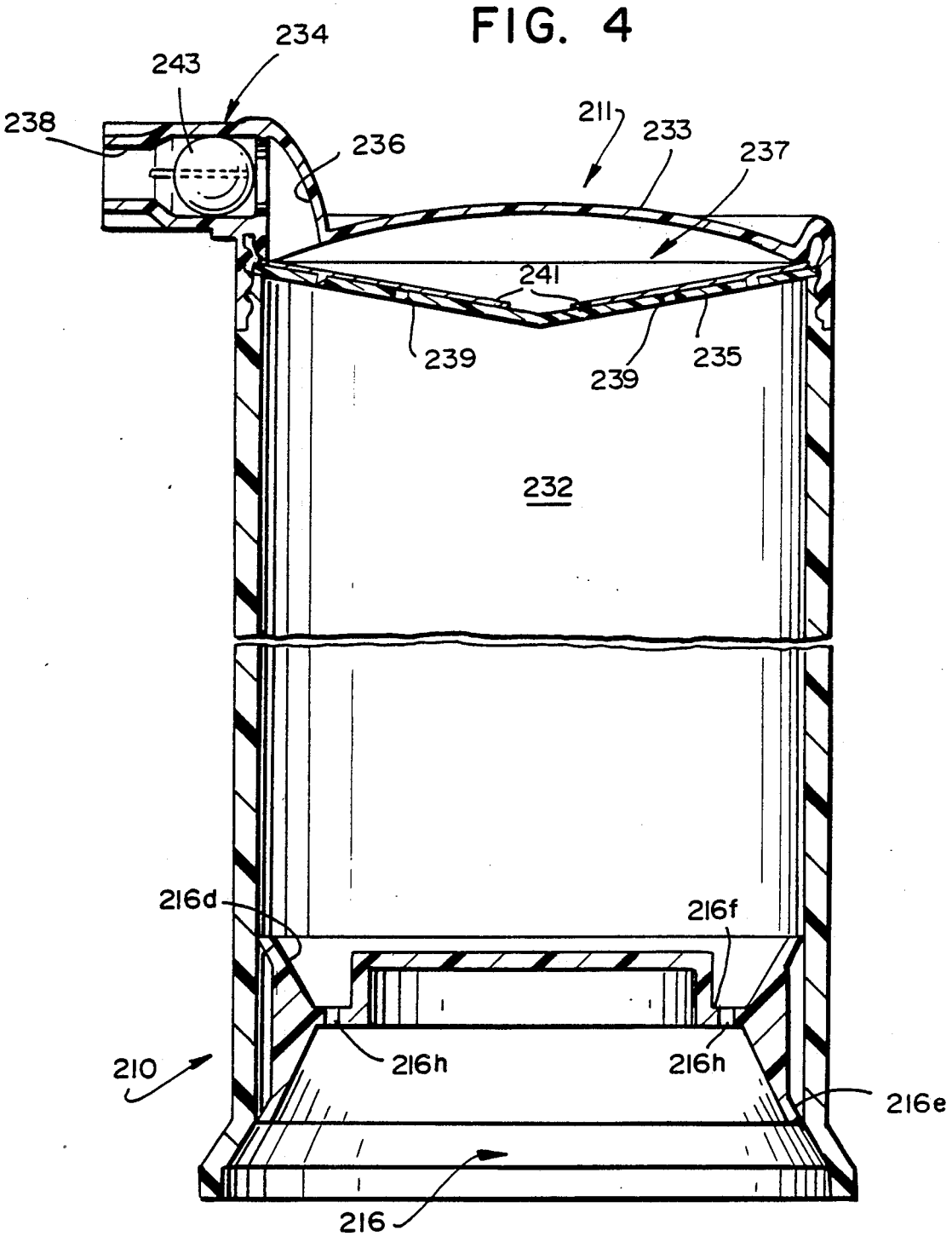
FIG. 4 is a view, similar to FIG. 1, of another embodiment of the invention.

The pump dispenser 10 of FIG. 1 has a cylindrical body 12 which is open at its lower end 14 to the atmosphere, except for the presence of the one-way floating piston 16 which makes sealing engagement with the interior wall surface of the body 12 as will be described in detail hereinafter. A downwardly and outwardly flaring metal skirt 18 or the like carried by the piston 16 also engages the interior wall surface of the body 12. The skirt 18 is sufficiently resilient that it will deflect downwardly to any extent necessary to permit the piston 16 to move upwardly in the body 12, yet it is sufficiently stiff as to bite into the wall surface and prevent downward, retrograde movement by the piston 16 within the body 12. A cover 19 is also carried by piston 16 to provide a finished appearance.

The opposite, upper end 20 of the body 12 includes an upright, centrally disposed sleeve 22 which is supported by transversely extending web means 24. The sleeve 22 reciprocably receives the tubular stem 26 of a pumping piston 28 which at its circumferential periphery sealingly engages the inner wall surface of body 12. A passage 30 is defined within the tubular stem 26, and the two pistons 16 and 28 cooperate with the body 12 to form a pumping chamber or reservoir 32 therebetween.

The sleeve 22 also partially receives the lower end of a tubular discharge spout or nozzle 34 which itself receives the upper end of the tubular stem 26 and is securely attached thereto. A passage 36 is defined within the tubular spout or nozzle 34, and a discharge outlet 38 is presented at the uppermost end thereof. A coil spring 40 encircles the tubular stem 26 and is trapped between the lower extremity of the spout 34 and a lower, inturned terminus 42 of the sleeve 22 for the purpose of yieldably biasing the piston 28 and the spout 34 toward an upper, undepressed position as illustrated in FIG. 1 as limited by the lower sleeve terminus 42 abutting the inside of the concave pumping face 29 of piston 28.

The dispenser 10 is also provided with an actuator 46 in the form of a lever having a fulcrum 48 associated with the spout 34. The fulcrum 48 takes the form of a pair of pins projecting laterally from opposite sides of the spout 34, and a pair of legs 50 of the actuator 46 (only one leg 50 being illustrated) straddle the spout 34 and rest at their midpoints on the respective fulcrum pins 48. Forwardmost ends of the legs 50 are retainingly hooked beneath overhanging proximal ledges 52 (only one being shown) on upstanding housing structure 54 at the upper end 20 of the body 12.

The actuator lever 46 includes a finger-engaging portion 56 on one side of the fulcrum pins 48, as well as a valve flap portion 58 on the opposite side of the fulcrum pins 48. The valve portion 58 is integrally connected with the finger-engaging portion 56 by an intermediate web portion 60, and it will be noted that the valve portion 58 is of such a dimension as to completely cover and thereby close the outlet 38 when the actuator 46 is in its FIG. 1 position. If desired, the spout 34 may have an angled upper end as shown in order to best accommodate the valve portion 58 and web portion 60 of actuating lever 46.

The dispenser 10 is operated as follows. The return spring 40 normally maintains the pumping piston 28, the spout 34 and the actuator 46 in the position of FIG. 1 in which valve flap 58 tightly covers and seals the outlet 38. Upon the application of downwardly directed finger pressure to the operating portion 56 of actuator 46, the latter rocks downwardly about the fulcrum pins 48 in a clockwise direction so that the valve flap 58 is lifted off the outlet 38. At the same time, because the legs 50 are retained beneath the ledges 52, depression of the operating portion 56 also causes the spout 34 and hence the pumping piston 28 to be shifted downwardly a short distance. This exerts a positive pumping pressure on the material contained within chamber 32 and forces the material upwardly through passages 30 and 36 and out the outlet 38. A ribbon of material is thus dispensed.

When pressure on the operating portion 56 is released, the spring 40 returns the spout 34 to its original raised position of FIG. 1 and likewise forces the pumping piston 28 back to its original position. By virtue of the fulcrum pins 48 moving upwardly at this time and the legs 50 being trapped beneath the ledges 52, the actuator 46 is rocked in a counterclockwise direction about fulcrum pins 48 to thereby return the operating portion 56 to its original undepressed position and lower the valve flap 58 once again into covering relationship with outlet 38. In view of the evacuation of product within the chamber 32 and the closing of the outlet 38 by valve flap 58, the floating piston 16 is moved upwardly within the chamber 32 by a corresponding amount as atmospheric pressure is applied against the bottom of the piston 16 via the open lower end 14 of the body 12.

Dispenser 10 may be filled with toothpaste in a conventional manner. Thus, empty dispensers 10 without the floating piston 16 are sent to a toothpaste filling machine (not shown) with dispensers 10 in an inverted position. Toothpaste is charged into the empty dispenser 10 and fills passage 36, then passage 30 and then the pumping chamber or reservoir 32. After completion of the filling operation, piston 16 is inserted to complete the assembly. The toothpaste filling apparatus may be any of the conventional machines used for filling toothpaste tubes. When a striped toothpaste is to be charged into the dispensers 10, such as a toothpaste having an opaque paste body with transparent or translucent gel stripes, then the filling apparatus of Evans British Patent No. 962,757 may be used, as is known.

With reference to FIG. 1, piston 16 has a body **16*a* having a convex top surface 16*b* that contacts the toothpaste or other fluent material in dispenser 10, whereas pumping piston 28 has a complementary concave surface 29 in contact with the fluent material. An outer rim portion 16*c* is carried by the body 16*a* and is provided with leading and trailing sealing members 16*d* and 16*e* extending laterally outwardly of the rim 16*c* forwardly and rearwardly, respectively. Sealing members 16*d* and 16*e* have sufficient flexibility as to sealingly engage the inner wall of dispenser 10. Sealing members 16*d* and 16*e* operate to prevent leakage of material from the dispenser 10**.

To provide the leading sealing member **16*d* with the required flexibility to operate as a sealing means, it must be spaced from the body 16*a*, e.g. by means of the web 16*f* (FIGS. 1 and 2), which thus creates the gutter or channel 16*g* between the sealing member 16*d* and body 16*a*. Since the sealing member 16*d* sealingly engages the inner wall of the dispenser 10, it is inevitable that air will be trapped between the piston body 16*a* and the toothpaste when the piston 16 is inserted into the dispenser 10 with the dispenser in an inverted position during filling. It is believed that the trapped air accumulates in the gutter or channel 16*g*. In any case, the air-venting passages 16*h* in the web 16*f* allow the trapped air to escape by passing through passages 16*h* as the piston 16 is inserted into dispenser 10**.

The number and size of the air-venting passages **16*h* must be sufficient to permit venting of trapped air and yet prevent excessive loss of toothpaste through the passages 16*h*. Preferably there will be a plurality of passages 16*h*, but for a small pump one such passage could be sufficient. Usually, the passages 16*h* will be symmetrically disposed with respect to the axis of piston 16**.

Dispensers 10 containing 4.6 and 8.2 ounces of toothpaste were each provided with a piston 16 having two and four passages **16*h* in web 16*f*, respectively, spaced apart by 180° and 90°, respectively. The passages 16*h* were about 0.090 inch long and 0.003 inch wide. For both sizes of the dispenser 10, the passages 16*h* operated to vent entrapped air from the pump, thus avoiding the problems associated with air bubbles discussed above. For both sizes of the dispenser 10, there was only a minimal amount of seepage of toothpaste through the passages 16*h***, namely about 0.01 g per passage, during dispensing of the entire contents of the pumps.

Passages **16*h* are formed in web 16*f* before piston 16 is inserted into the dispenser. A tool provided with a number of projecting, sharply pointed knife blades corresponding to the number and position of passages 16*h* is presently used to pierce web 16*f* and thus form passages 16*h***.

FIG. 3 shows an alternative embodiment of the invention wherein piston 116 is moved upwardly by means of the piston rod 100, and one-way clutch 101 prevents retrograde movement. Piston rod 100 links the piston 116 to the actuator (not shown) of the dispenser **110*n* a known manner. The operation of a dispenser 110** equipped in this manner is well known. See, for example, Spatz U.S. Pat. No. 3,255,935 and published U.K. No. application 2,152,152A.

Piston 116 has sealing members **116*d* and 116*e*, and air-venting passages 116*h* are provided in web 116*f* to allow entrapped air to escape as piston 116 is inserted into dispenser 110**.

Dispenser 210 shown in FIG. 4 is the two-chamber pump dispenser illustrated in U.S. Pat. No. 3,361,305 to Walter B. Spatz, but modified to include the piston or follower 216 of the invention in place of the piston depicted in the Spatz patent. Dispenser 210 includes a reservoir 232 for storing the fluent mass and a pump mechanism 211 formed by depressible actuator wall or diaphragm 233 and end wall 235, which together enclose a pump chamber 237. End wall 235 has ports 239 formed therein through which the fluent mass may flow from reservoir 232 to chamber 237. One-way inlet valve 241 normally closes ports 239 and prevents reverse flow of the fluent mass from pump chamber 237 back into reservoir 232. The details of inlet flapper valve 241 are shown in Spatz U.S. Pat. No. 3,361,305. The fluent mass exits pump chamber 237 by means of discharge spout or nozzle 234, which includes passage 236 and discharge outlet 238.

Piston or follower 216 includes sealing members **216*d* and 216*e*, and air-venting passages 216*h* are provided in web 216*f* to allow entrapped air to escape as piston or follower 216 is inserted in dispenser 210**.

To operate dispenser 210, actuator wall 233 is depressed to exert pressure on the fluent mass in pump chamber 237. When the actuator wall 233 is pressed down, ball valve 243 opens and flapper valve 241 remains closed, due to the force exerted by the fluent material under pressure in pump chamber 237. Fluent mass is thus dispensed from pump chamber 237 through passages 236 and 238 in nozzle 234.

The flapper valve 241 being closed prevents the pressure exerted on the fluent mass in pump chamber 237 from being imparted to the fluent mass in the reservoir 232, which would otherwise cause retrograde movement of the piston 216. Upon relief of the pressure on actuator wall 233, the actuator wall 233 returns elastically to its original position, thus creating a partial vacuum in the pump chamber 237, which in turn drawn ball valve 243 back to its closed position and unseats flapper valve 241 thereby opening ports 239. As a result, fluent mass flows from reservoir 232 into pump chamber 237 via ports 239, and piston or follower 216 follows toward the pump chamber 237 by atmospheric air acting thereon. When the pressure in pump chamber 237 returns to atmospheric, the dispenser 210 is restored to its original position as shown in FIG. 4.

In contrast to the embodiments shown in FIGS. 1–3, the piston 216 itself is not provided with means to prevent retrograde movement, such as the skirt 18 or one-way clutch 101. Dispenser 210 does not require a one-way piston or follower, because the pumping action is isolated from the reservoir 232, and hence from the piston or follower 216, by means of the flapper valve 241.

While the present invention has been described in terms of a toothpaste dispenser, as is known the pump dispensers of the type described herein may be used for other fluent masses, such as cosmetic lotions, gels and creams.

I claim:

1. A pump dispenser, which comprises wall means forming an elongated reservoir for storing fluent material, an outlet means at one end of the reservoir, pumping means for pumping said fluent material out of said dispenser via said outlet means, and a piston at the other end of the reservoir in contact with said fluent material, said piston comprising a body portion having a surface for contacting material in said reservoir, a flexible annular sealing means for sealingly engaging the inner wall of the reservoir, and air-venting passage means formed in said piston for permitting air trapped between fluent material in the reservoir and said piston to pass therethrough to the atmosphere as said piston is inserted into a said dispenser and into contact with said material.

2. The dispenser according to claim 1, wherein said piston comprises a rim portion exteriorly of said body portion, said sealing means extending laterally outwardly from said rim portion.

3. The dispenser according to claim 2, wherein said rim portion is spaced from said body portion by means of an annular web portion connected therebetween, said air-venting passage means being provided in said web means.

4. The dispenser according to claim 3, wherein said web means is provided with a plurality of said air-venting passage means.

5. The dispenser according to claim 3, wherein said sealing means comprises a leading sealing member adjacent to said web means and extending laterally outwardly in a direction toward said outlet means for sealingly engaging the inner wall of said reservoir.

6. The dispenser according to claim 5, wherein said web means is provided with a plurality of said air-venting passage means.

7. The dispenser according to claim 6, wherein said fluent material is toothpaste.

8. The dispenser according to claim 1, wherein said fluent material is toothpaste.

9. A toothpaste pump dispenser, which comprises wall means forming an elongated reservoir for storing toothpaste, an outlet means at one end of the reservoir, pumping means for pumping said toothpaste out of said dispenser via said outlet means, and a piston at the other end of the reservoir in contact with said toothpaste, said piston comprising a body portion having a surface for contacting toothpaste in said reservoir, a flexible annular sealing means for sealingly engaging the inner wall of the reservoir, and air-venting passage means formed in said piston for permitting air trapped between toothpaste in the reservoir and said piston to pass therethrough to the atmosphere as said piston is inserted into a said dispenser and into contact with said toothpaste.

10. The dispenser according to claim 9, wherein said piston is a one-way piston means for progressively moving only in the direction toward said outlet means as said toothpaste in said reservoir is depleted.

11. The dispenser according to claim 9, wherein said pumping means comprises a pump chamber arranged between and in communication with said outlet means and said reservoir, and valve means is provided for enabling toothpaste to be pumped out of said pump chamber via said outlet means during a dispensing operation of said pumping means and to enable toothpaste to flow into said pump chamber from said reservoir after each said dispensing operation.

12. The dispenser according to claim 9, wherein said piston comprises a rim portion exteriorly of said body portion, said sealing means extending laterally outwardly from said rim portion.

13. The dispenser according to claim 12, wherein said rim portion is spaced from said body portion by means of an annular web means connected therebetween, said air-venting passage means being provided in said web means.

14. The dispenser according to claim 13, wherein said web means is provided with a plurality of said air-venting passage means.

15. The dispenser according to claim 13, wherein said sealing means comprises a leading sealing member adjacent to said web means and extending laterally outwardly in a direction toward said outlet means for sealingly engaging the inner wall of said reservoir.

16. The dispenser according to claim 15, wherein said web means is provided with a plurality of said air-venting passage means.

* * * * *